United States Patent [19]

Markwitz

[11] 3,987,506

[45] Oct. 26, 1976

[54] THERAPEUTIC AID

[75] Inventor: Bernhard Markwitz, Hamburg, Germany

[73] Assignee: KG Bema "Schwimmflugel" Warenhandelsgesellschaft mbH & Co., Hamburg, Germany

[22] Filed: July 16, 1975

[21] Appl. No.: 596,459

[30] Foreign Application Priority Data

July 26, 1974 Germany ..... 2436018

[52] U.S. Cl. ..... 5/338; 5/349

[51] Int. Cl.[2] ..... A47C 27/08

[58] Field of Search ..... 5/348 R, 349, 350, 337, 5/338, 365–367; 297/453, 284

[56] References Cited

UNITED STATES PATENTS

| | | | |
|---|---|---|---|
| 3,128,480 | 4/1964 | Lineback | 5/349 X |
| 3,235,892 | 2/1966 | Emery | 5/348 R X |
| 3,296,635 | 1/1967 | O'Hanlan | 5/348 R |
| 3,583,008 | 6/1971 | Edwards | 5/349 |

*Primary Examiner*—Paul R. Gilliam
*Attorney, Agent, or Firm*—Beaman & Beaman

[57] ABSTRACT

A therapeutic aid comprises a fluid-filled cushion formed from sheets of synthetic plastics material welded together with a weld line dividing the interior of the cushion into two compartments. This weld line is interrupted to provide a flow opening allowing fluid to flow between the two compartments and the portions of the weld line adjacent the opening having rounded edges and are of increased width.

6 Claims, 1 Drawing Figure

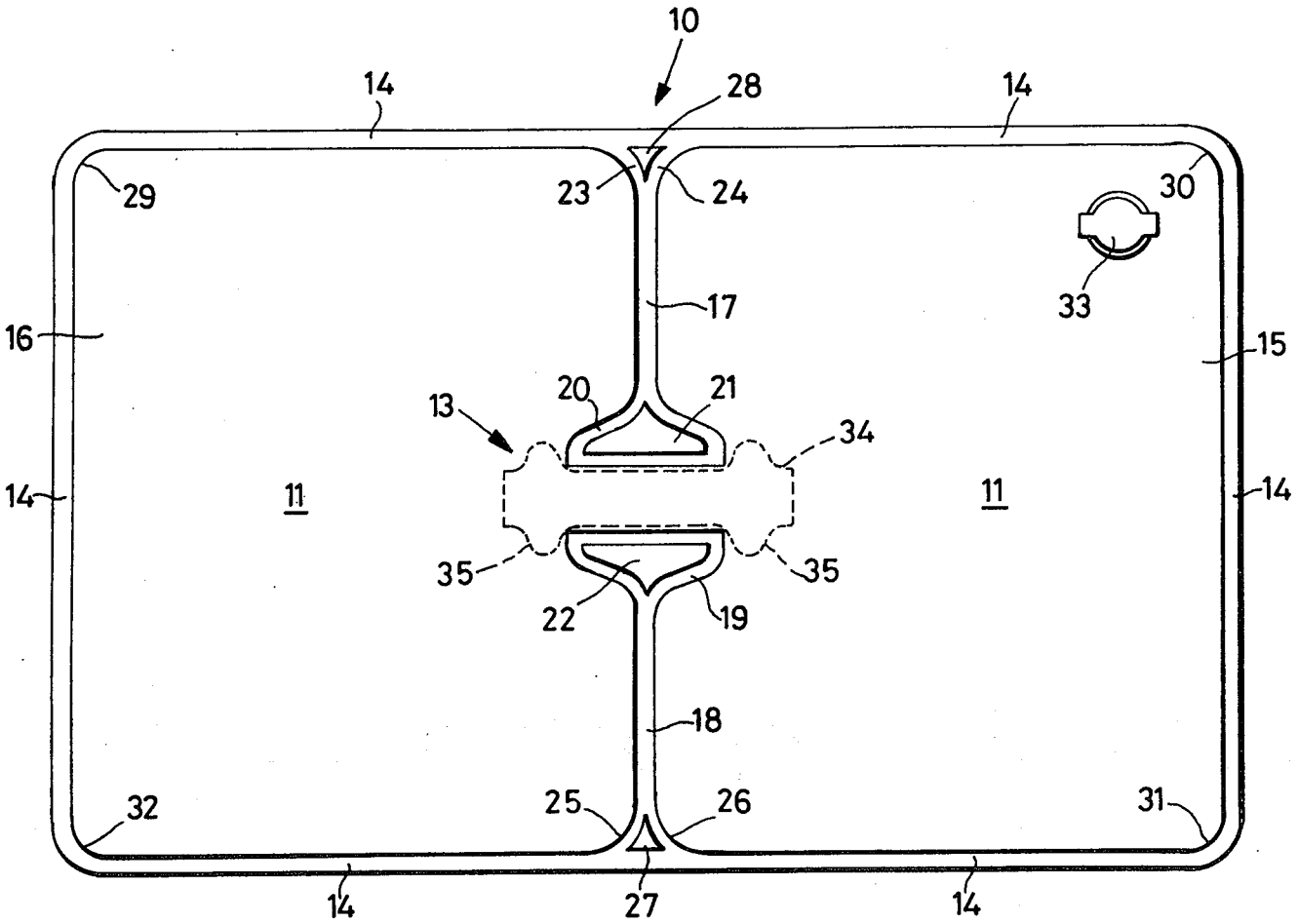
10
11
11
13
14
14
14
14
14
15
16
17
18
19
20
21
22
23
24
25
26
27
28
29
30
31
32
33
34
35
35

THERAPEUTIC AID

FIELD OF THE INVENTION

This invention relates to a therapeutic aid in the form of a fluid-filled cushion comprising an envelope made of a synthetic plastics material with the surfaces of the envelope welded together by a weld line which divides the interior of the cushion into compartments, said line having at least one interruption serving as a restricted flow opening permitting flow of fluid between the compartments.

BACKGROUND OF THE INVENTION

Therapeutic or training cushions of this type are used mainly as aids for physical exercises, for example for training the feet muscles and lower leg muscles after a fracture, paralysis or immobilization of any kind, for early mobilization of tissue after an operation in order to avoid emboli, for training the spine and bottom muscles, for coordinating the various functions of the hand and arm muscles and as an exercising apparatus for the neck muscles.

The cushion is placed under the muscles to be strengthened with the patient lying, standing or sitting according to the required exercise whereby, owing to rolling, weight displacement or to pressing, the fluid is forced from one compartment of the cushion into the other. This process is periodically repeated to complete a series of exercises.

In known cushions of the type referred to above it can happen, in use, that the weld line is broken especially at the ends thereof adjacent the flow opening. As a result, the flow opening is enlarged and the resistance to fluid flow is reduced so that the intended purpose of the exercise can no longer be achieved. The resistance to flow and therewith the achievement of the user is also dependent on the pressure to which the cushion as a whole is subjected.

It is an object of the invention to provide a therapeutic or training cushion of the type referred to which is such that the resistance of the flow opening remains almost unchanged even under high stress and after long use.

SUMMARY OF THE INVENTION

According to the invention, the ends of the portions of the weld line adjacent the flow opening are enlarged to provide rounded edge portions which are substantially wider than the remainder of the weld line.

With these arrangements, the edges of the weld line are not pulled apart even under very high static or alternating loads and that the resistance to flow determining the work involved by a patient is only slightly affected or almost not at all by the pressure exerted on the cushion as a whole.

These advantageous features of the cushion according to the invention are probably attributable to the fact that the weld line is no longer loaded from three sides over very small areas at the edges of the flow opening; instead the tensions arising in use are distributed over a larger area.

BRIEF DESCRIPTION OF THE DRAWING

The single FIGURE of the drawing is a plan view of a therapeutic cushion.

DESCRIPTION OF THE PREFERRED EMBODIMENT

The training or therapeutic cushion 10 comprises a one-piece upper section 11 and a similarly one-piece lower section (not shown), the two pieces being welded together so as to be sealed around their outer edges by means of a peripheral seam 14. A central separating weld line consisting of two parts 17 and 18 divides the interior of the cushion 10 into two compartments 15 and 16 connected by a flow opening 13 formed as a pressure-regulating valve at the gap between the two parts 17 and 18 of the weld line. The ends of the two parts 17, 18 of the weld line adjacent the opening 13 are enlarged by the provision of rounded edges 19, 20 which are in fact in the form of closed loops which enclose unwelded, uninflatable cushion parts 21, 22. In an alternative arrangement these cushion parts 21, 22 are completely welded together.

At the points of connection of the outer ends of the parts 17, 18 of the weld line to the peripheral seam 14 similar, rounded or curved sections 23 and 24 or 25 and 26 are provided joining the peripheral seam 14 to the weld line. In the embodiment shown, these sections enclose unwelded and uninflatable cushion parts 27, 28, which can alternatively be completely welded together. At the four corners 29, 30, 31 and 32 of the cushion 10 the peripheral weld seam 14 is similarly curved. By avoiding any sharp corners on the weld lines the ability to resist unwanted tearing is increased even at the other sealed points of the cushion. A valve 33 is provided in one of the cushion parts whereby the cushion can be filled with a suitable fluid, which is usually air.

Between the rounded edges 19, 20 is defined a flow opening which is relatively long and tubular or pipe-shaped in comparison with a simple gap in a thin weld line. This opening can be of larger cross-section than a simple gap whilst having a comparable resistance to flow. It has been found, with a tubular flow opening the resistance to flow is less dependent on the load exerted on the cushion and on variations in the load than with a simple gap. In order to achieve this favourable result with still greater reliability, a small pipe 34 (shown in broken lines), the dimensions of which depends on the desired resistance to flow, may be inserted in the flow opening 13 so as to prevent compression or collapsing of the flow opening. The small pipe 34 is formed of a relatively resistant yet soft synthetic plastics material, particularly polyvinyl chloride or polyethylene in order to avoid chafing of the material forming the envelope of the cushion.

The use of a small pipe offers the further advantage that it is easier to make the flow resistance adjustable, for example by means of an adjusting valve inserted in the small pipe and capable of being operated from outside the cushion. In order to prevent the small pipe 34 from being displaced it is preferably secured against displacement. This can be achieved very simply by fixing the small pipe 34 to the cushion material, particularly by welding or using an adhesive. In addition or instead, securement against displacement can be achieved by providing the small pipe 34 with projections 35 in the form of knobs, toruses or the like which are moulded integrally with or attached to the pipe, in particular welded or stuck on to the pipe whereby the pipe is either located frictionally or positively mechanically held in place. In the embodiment shown in the drawing, the projections 35 are formed as relatively thick toruses. In the manufacture of this cushion the weld line 17, 18 dividing the interior of the cushion into two compartments can be formed after interposing the small pipe. Alternatively, the weld line 17, 18 can be formed first and then a small pipe inserted, which, at least at one end, does not yet have the thick annular projections; the latter is then later stuck or welded on. Obviously, when using somewhat flatter or smaller projections it would be possible for a small pipe provided with projections to be pushed into the space between the edges 19, 20 and then to be jammed tight so that it can no longer be displaced by the forces arising in normal use. Generally, however, positive mechanical interlocking is preferred.

The resistance to flow in the flow opening can be predetermined by appropriate selection of corresponding internal diameters and/or lengths of the small pipe. It is especially advantageous if a range of pipes are used with different internal diameters but with the same external diameters; then one and the same embodiment of cushion can be used. Another simple variation consists of using one, two or more small pipes depending on the desired flow resistance; in addition of course, the size of the space or gap between the edges 19, 20 must then be adapted accordingly.

What is claimed is:

1. A therapeutic aid in the form of a cushion comprising a two-compartment envelope formed of flexible, fluid impervious, heat-weldable, synthetic plastic material, an elongated weld line defining first and second compartments within said envelope, said weld line including first and second portions, said portions each including an end region and said end regions being spaced from each other forming a restricted port in said weld line permitting communication between said compartments, each end region including a port portion transversely disposed to the length of said weld line, said port portions of each end region being substantially parallel to each other to define a tubular port through said weld line whereby fluid may flow through said port between said compartments.

2. In a therapeutic aid as in claim 1 wherein said envelope comprises a pair of sheets of synthetic plastic material having peripheries and heat-welded together at their peripheries to form a peripheral seam, said weld line portions each having arcuate portions connecting to and merging with said seam in a manner eliminating sharp corners, said arcuate portions and seam defining uninflatable sections of limited area.

3. In a therapeutic aid as in claim 1 wherein said end regions are defined by heat-welded portions having a dimension transverse to length of said weld line several times the transverse dimension of said weld line adjacent said end regions, said heat-welded portions defining said end regions defining uninflatable cushion sections adjacent said port.

4. In a therapeutic aid as in claim 1, a flexible tubular conduit within said port having an inner flow passage of a dimension to provide the desired flow resistance between said compartments as the envelope material defining said compartments is compressed.

5. In a therapeutic aid as in claim 4, means affixing said conduit within said port.

6. In a therapeutic aid as in claim 5 wherein said means affixing said conduit within said port comprises projections defined upon said conduit of a cross-sectional dimension greater than that of said port, said projections being located adjacent said end regions and beyond the length of said port as defined by said port portions.

* * * * *